US010333232B2

(12) United States Patent
Wu et al.

(10) Patent No.: US 10,333,232 B2
(45) Date of Patent: Jun. 25, 2019

(54) WIRE CONNECTION TERMINAL DEVICE

(71) Applicants: SWITCHLAB INC., New Taipei (TW); SWITCHLAB (SHANGHAI) CO., LTD., Shanghai (CN)

(72) Inventors: Chih-Yuan Wu, New Taipei (TW); Chih-Kun Hsiao, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 15/480,740

(22) Filed: Apr. 6, 2017

(65) Prior Publication Data

US 2017/0331201 A1 Nov. 16, 2017

(30) Foreign Application Priority Data

May 16, 2016 (TW) ..... 105115051 A

(51) Int. Cl.
*H01R 4/48* (2006.01)
*H01R 9/24* (2006.01)

(52) U.S. Cl.
CPC ..... *H01R 4/4818* (2013.01); *H01R 4/489* (2013.01); *H01R 4/4836* (2013.01); *H01R 9/2416* (2013.01)

(58) Field of Classification Search
CPC .. H01R 4/2412; H01R 4/2408; H01R 4/4818; H01R 4/4845; H01R 11/282
USPC ..... 439/410, 411, 441, 828, 829, 834, 835
See application file for complete search history.

(56) References Cited

U.S. PATENT DOCUMENTS 6,126,494 A * 10/2000 Fuchs ..... H01R 4/4845 439/441
6,146,186 A * 11/2000 Barrat ..... H01R 4/2416 439/410
6,146,217 A * 11/2000 Osada ..... H01R 4/4836 439/441
8,113,858 B1 * 2/2012 Chiang ..... H01R 13/701 439/188
8,262,422 B1 * 9/2012 Chiang ..... H01R 4/4836 439/441
8,851,920 B2 * 10/2014 Wu ..... H01R 4/4827 439/441
8,979,573 B1 * 3/2015 Barber ..... H01R 4/4836 439/441
9,160,085 B2 * 10/2015 Jun ..... H01R 4/4827
9,240,650 B2 * 1/2016 Wu ..... H01R 4/48
(Continued)

*Primary Examiner* — Thanh Tam T Le
(74) *Attorney, Agent, or Firm* — Rosenberg, Klein & Lee

(57) ABSTRACT

A wire connection terminal device includes a main body and a pressing/moving unit assembled with the main body. The pressing/moving unit has a shafted section, a cam section connected with the shafted section and a force application section formed on the cam section and a press section formed on the cam section. The cam section can freely rotate or swing within a chamber defined by the main body. A metal leaf spring is disposed in the chamber of the main body for pressing and electrically connecting with a conductive wire. The metal leaf spring is responsive to the motion of the pressing/moving unit to release the conductive wire. The wire connection terminal device improves the shortcomings of the conventional structure that the volume of the case and the operational space are larger and the motional travel is longer.

44 Claims, 7 Drawing Sheets

(56) References Cited

U.S. PATENT DOCUMENTS 9,466,894 B2 * 10/2016 Wu ..... H01R 4/4836
9,774,107 B2 * 9/2017 Kamo ..... H01R 9/2416

* cited by examiner

WIRE CONNECTION TERMINAL DEVICE

BACKGROUND OF THE INVENTION

1. Field of the Invention

The present invention relates generally to the structural design of a wire connection terminal device, and more particularly to a terminal device for a conductive wire to plug therein. The terminal has a pressing/moving unit. The pressing/moving unit can freely rotate or swing within a chamber of the main body of the terminal. A metal leaf spring is disposed in the chamber of the main body for pressing and electrically connecting with the conductive wire. The metal leaf spring is responsive to the motion of the pressing/moving unit to release the conductive wire from the pressing of the metal leaf spring.

2. Description of the Related Art

A conventional terminal device or wire-pressing terminal has an insulation case (generally made of plastic material) and a metal leaf spring mounted in the insulation case to press and electrically connect with a conductive wire plugged in the insulation case. A tool can be inserted into the insulation case to press and move the metal leaf spring so as to release the conductive wire.

Basically, the metal leaf spring of such kind of connection terminal is assembled with a slenderer or narrower terminal pin in a symmetrical form for plugging on a circuit board (such as a PCB, not shown) and electrically connecting with the circuit board.

With respect to such kind of terminal device, it is necessary to operate a tool to electrically disconnect the metal leaf spring from the conductive wire. This is quite inconvenient. In order to eliminate this shortcoming, an improved terminal device has been disclosed. The improved terminal device has a shift member or drive member disposed on the insulation case for controlling the metal leaf spring to press and electrically connect with the conductive wire plugged into the case or release the conductive wire.

Please refer to FIG. 1, which shows a conventional connection terminal equipped with the shift member. Such kind of terminal device can be plugged on a circuit board (such as a PCB, not shown). The connection terminal includes an insulation case 10 and a shift member 20 mounted on the case 10. The case 10 has a perforation or a wire inlet 12 for a conductive wire 50 to plug into the case 10. The case 10 defines a chamber 11 in which a metal leaf spring 30 is mounted. By means of operating the shift member 20, the metal leaf spring 30 is controlled to contact or electrically connect with the conductive wire 50 plugged into the case 10.

To speak more specifically, the metal leaf spring 30 includes ahead end 31 inserted on a hole 21 of the shift member 20. After the conductive wire 50 is plugged into the case 10, the head end 31 of the metal leaf spring 30 will bite the conductive wire 50 and prevent the conductive wire 50 from easily detaching from the metal leaf spring 30 or the case 10. Only when an operator pushes down the shift member 20 to drive the head end 31 of the metal leaf spring 30, the conductive wire 50 is released from the pressing of the metal leaf spring 30.

However, as well known by those who are skilled in this field, the above conventional connection terminal has a relatively complicated structure that the shift member 20 is formed with the hole 21 on which the head end 31 of the metal leaf spring 30 is inserted. Also, it is more troublesome to assemble these components. In addition, the volume of the shift member 20 must be enlarged so that the handle 22 can protrude out of the case 10 for an operator to operate. This will increase the possibility of mis-touch of the operator to the shift member 20. Moreover, with respect to the above conventional connection terminal, it is necessary to reserve a larger operational space around the connection terminal to allow the operation and motion of the shift member 20. This will more limit the arrangement of the environmental equipment in the working site. This is not what we expect.

FIG. 2 shows a connection terminal equipped with a drive member 25 to minimize the operational and motional space of the conventional shift member 20 or increase the arrangement space of the environmental equipment in the working site. The connection terminal has a case 10 defining a chamber 11. The chamber 11 is formed with a longitudinal cavity 13 in which the drive member 25 is mounted. The drive member 25 is allowed to reciprocally move along the cavity 13.

When the drive member 25 pressed down the head end 31 of the metal leaf spring 30, the conductive wire 50 is allowed to plug into the case 10 from the wire inlet 12. After the down pressing force of the drive member 25 disappears, the head end 31 of the metal leaf spring 30 will bite the conductive wire 50 and electrically connect therewith. Only when an operator presses down the drive member 25 again to push away the head end 31 of the metal leaf spring 30, the conductive wire 50 is released from the pressing of the metal leaf spring 30.

It should be noted that the drive member 25 must have sufficient operational travel so as to truly control and drive the metal leaf spring 30 to press or release the conductive wire 50. Therefore, the above connection terminal must be structurally designed with a case 10 with enlarged volume so that the cavity 13 can provide larger longitudinal operational travel range. However, this is unbeneficial to the structural design of the connection terminal. Also, the drive member 25 has the structural form that protrudes from the case 10 in normal state. This increases the possibility of mis-touch of the operator to the drive member 25.

Please now refer to FIG. 3, which shows a conventional connection terminal employs a push member 29 in cooperation with an α-shaped metal leaf spring 30. This connection terminal improves the shortcoming of mis-touch of the operator. The case 10 is formed with a transverse slot 14, whereby the push member 29 can transversely move along the slot 14 to push/press the metal leaf spring 30 and expose the opening 32 of the metal leaf spring 30. Under such circumstance, the conductive wire 50 can be plugged into the case 10 and the opening 32 from the wire inlet 12.

After the push member 29 restores to its home position, the head end 31 of the metal leaf spring 30 cooperates with the opening 32 to bite the conductive wire 50 and electrically connect therewith. Only when an operator again operates the push member 29 to transversely move along the slot 14 to push away the head end 31 of the metal leaf spring 30 and expose the opening 32, the conductive wire 50 is released from the pressing of the metal leaf spring 30.

It should be noted that the push member 29 must have sufficient operational travel so as to truly control and drive the metal leaf spring 30 to press or release the conductive wire 50. Therefore, the above connection terminal also must be structurally designed with a case 10 with enlarged volume so that the slot 14 can provide larger transverse operational travel range. Moreover, the moving direction of the push member 29 along the slot 14 is different from the down pressing direction of the metal leaf spring 30, (that is, the force is not applied in such a direction as to directly press down the metal leaf spring 30). Therefore, it is laborious to operate the push member 29.

With respect to the structural design and application of such kind of terminal devices, all the above terminal devices have the shortcoming that the structural design is not ideal. For example, the handle 22 of the shift member 20 or the drive member 25 protrudes out of the case 10 so that the possibility of mis-touch of the operator is increased or the arrangement space of the environmental equipment in the working site is affected. Also, the volume of the case 10 must be enlarged so that the drive member 25 or the push member 29 can have sufficient operational travel. In addition, it is laborious to operate the push member 29.

To speak representatively, the conventional connection terminals or terminal devices and the shift member (or drive member and push member) and the metal leaf spring have some shortcomings in design of the relevant assembling structures. To overcome the above shortcomings, it is necessary to redesign the assembling structures of the terminal devices and the shift member (or drive member and push member) and the metal leaf spring so as to change the structure and the use form of the terminal devices and widen the application range thereof as well as enhance the convenience in operation of the terminal devices.

In order to overcome or improve the above shortcomings of the structural form of the conventional terminal devices, the present invention provides a wire connection terminal device having several advantages in design. For example, in the condition that as a whole, the terminal device can keep securely pressing the conductive wire, the terminal device includes a pressing/moving unit. The force application direction of the pressing/moving unit is identical to the down pressing direction of the metal leaf spring so as to improve the shortcoming of the conventional terminal device that it is laborious to operate the push member. Also, in the condition that the volume of the case is not increased, the operational travel range of the pressing/moving unit is as minimized as possible. This improves the shortcomings of the conventional terminal device that the arrangement space of the environmental equipment in the working site is affected and the handle 22 of the shift member 20 or the drive member 25 protrudes out of the case 10 to cause mis-touch of the operator. All these are not substantially taught, suggested or disclosed in the above conventional terminal devices.

SUMMARY OF THE INVENTION

It is therefore a primary object of the present invention to provide a wire connection terminal device including a main body and a pressing/moving unit assembled with the main body. The pressing/moving unit has a shafted section, a cam section connected with the shafted section and a force application section formed on the cam section and a press section formed on the cam section. The cam section can freely rotate or swing within a chamber defined by the main body. A metal leaf spring is disposed in the chamber of the main body for pressing and electrically connecting with a conductive wire. The metal leaf spring is responsive to the motion of the pressing/moving unit to release the conductive wire. The wire connection terminal device improves the shortcomings of the conventional structure that the volume of the case and the operational space are larger and the motional travel is longer.

In the above wire connection terminal device, the shafted section of the pressing/moving unit is formed with a shaft hole pivotally connected on the shaft post of the main body, whereby the shaft post serves as a fulcrum or rotational center or swinging center for the pressing/moving unit to rotate or swing around the shaft post. In addition, the down pressing motional direction of the press section is identical to the motional direction of the metal leaf spring so that the metal leaf spring can be directly pressed and moved. Moreover, the distance between the force application section and the shafted section is smaller than the distance between the press section and the shafted section, whereby the operational travel of the pressing/moving unit is as minimized as possible.

The present invention can be best understood through the following description and accompanying drawings, wherein:

DETAILED DESCRIPTION OF THE PREFERRED EMBODIMENTS

Figure 2:
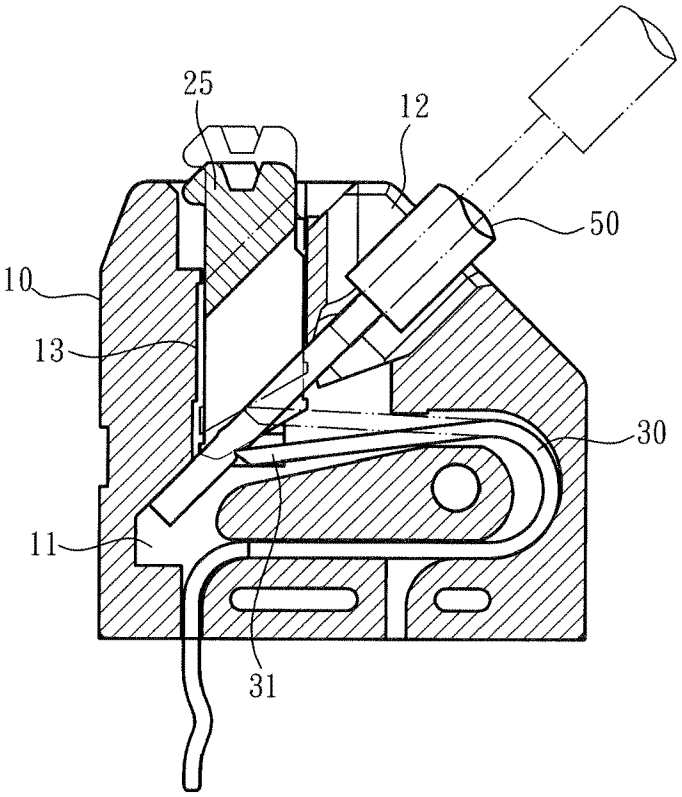
Fig. 2 PRIOR ART
FIG. 2 is a structural plane view of another conventional terminal device, showing that the drive member is assembled with the case, the metal leaf spring and the conductive wire and the drive member is operated.
Figure 1:
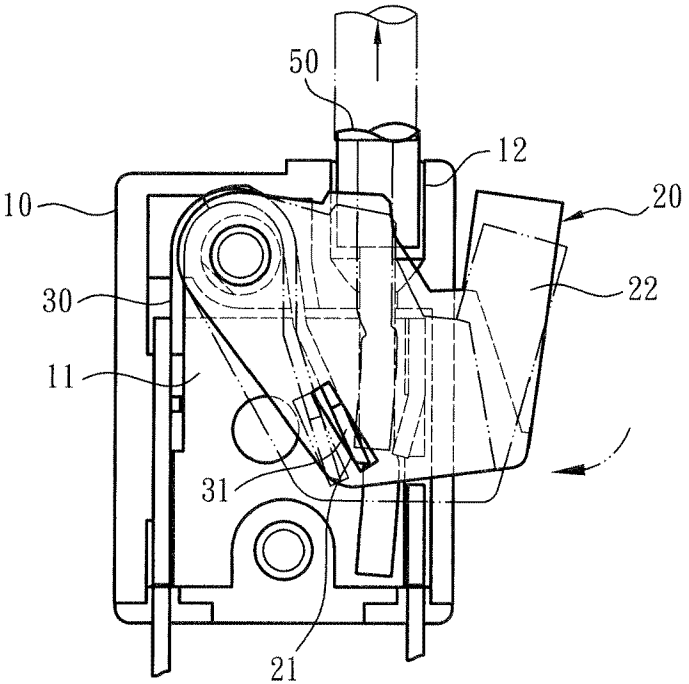
Fig. 1 PRIOR ART
FIG. 1 is a structural plane view of a conventional terminal device, showing that the shift member is assembled with the case, the metal leaf spring and the conductive wire and the shift member is operated.
Figure 3:
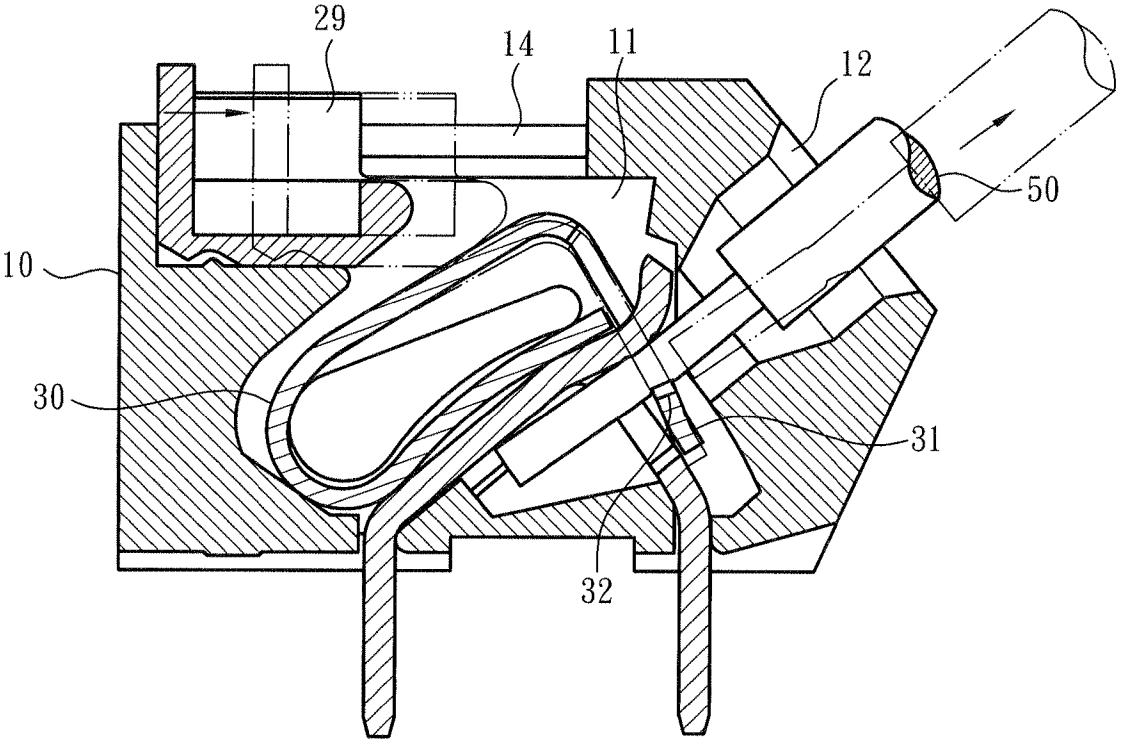
Fig. 3 PRIOR ART
FIG. 3 is a structural plane view of still another conventional terminal device, showing that the push member is assembled with the case, the metal leaf spring and the conductive wire and the push member is operated.
Figure 4:
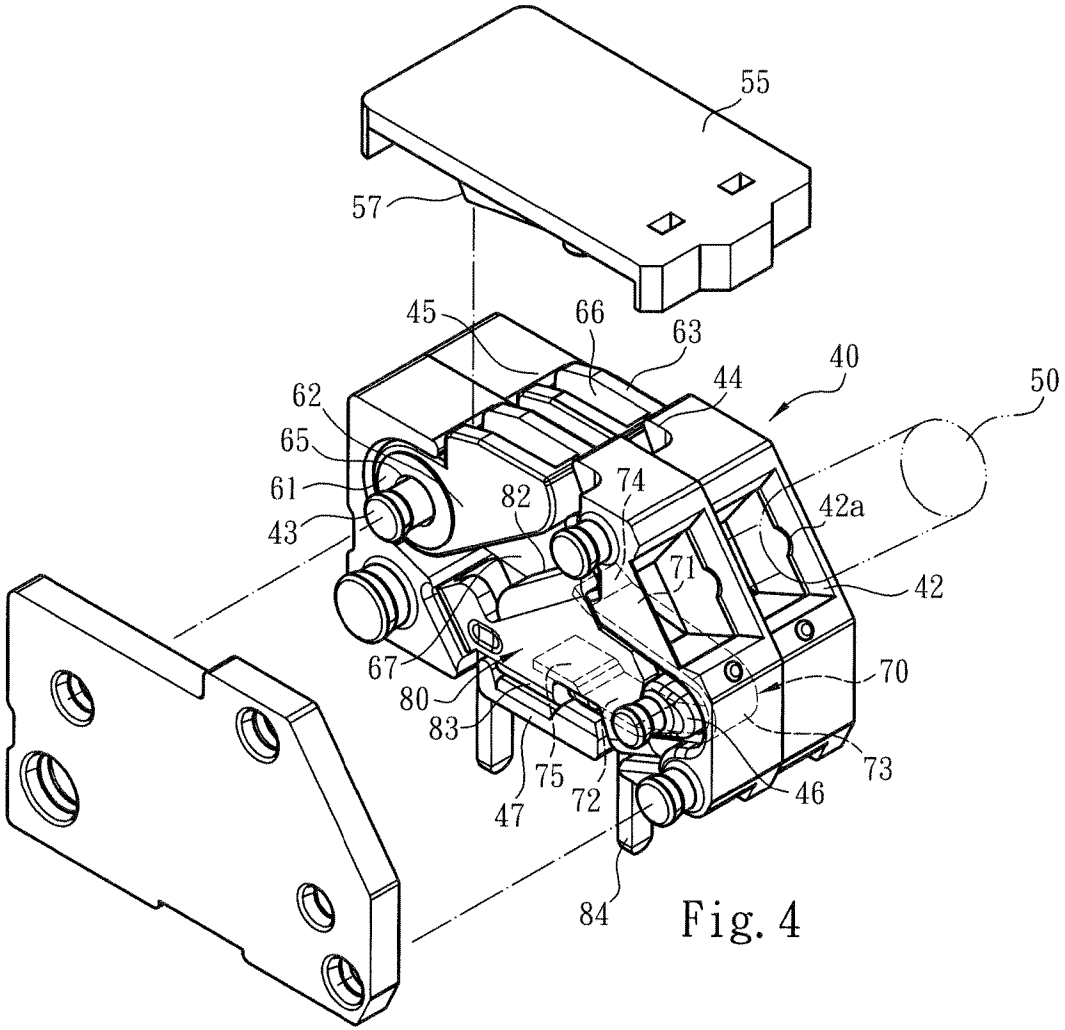
FIG. 4 is a structural perspective view of the present invention, showing that the case, the pressing/moving unit and the metal leaf spring are cooperatively assembled with each other.
Figure 5:
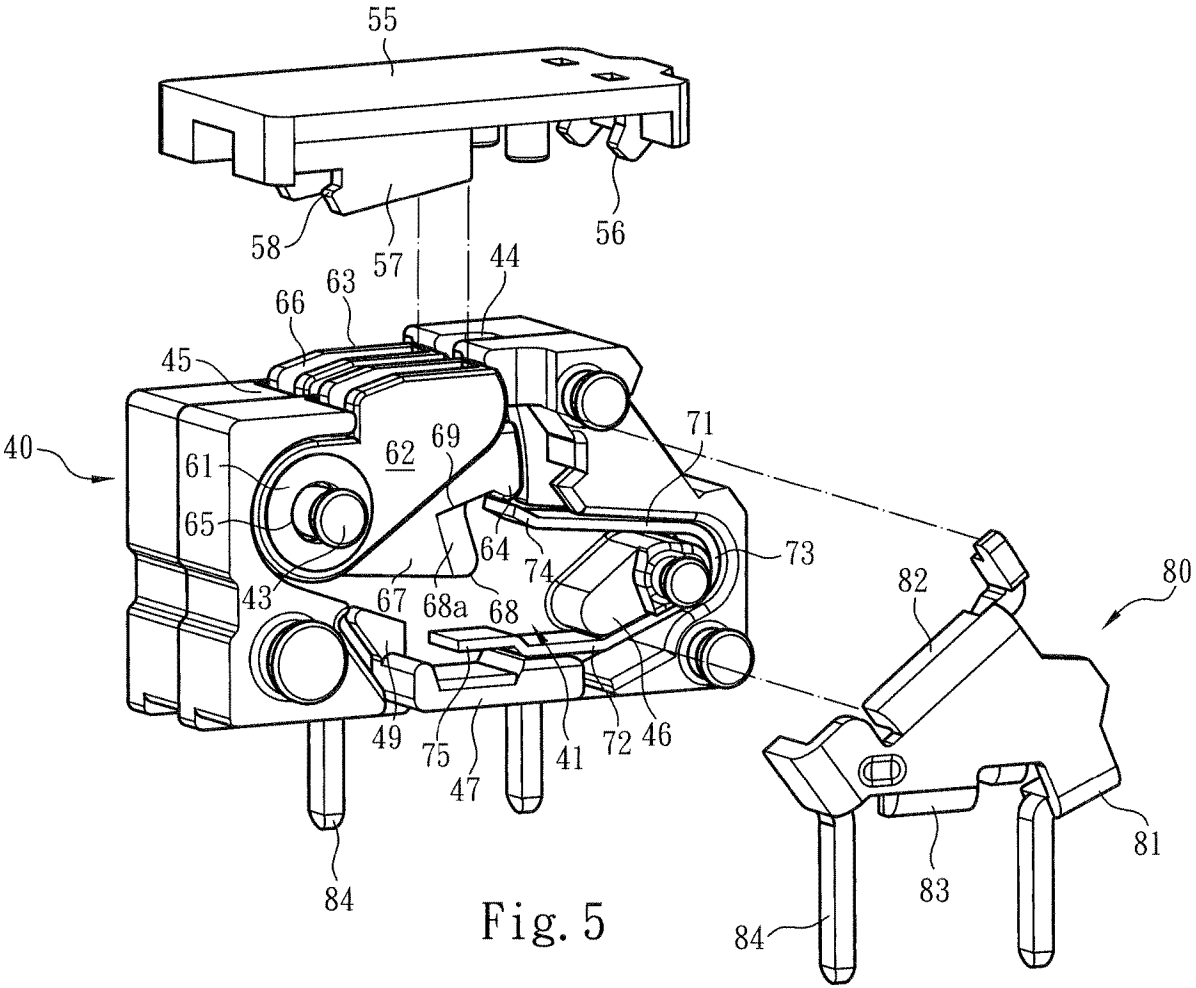
FIG. 5 is a structural perspective view of the present invention seen from another angle, showing that the case, the pressing/moving unit, the metal leaf spring and the terminal pin component are assembled with each other.
Figure 6:
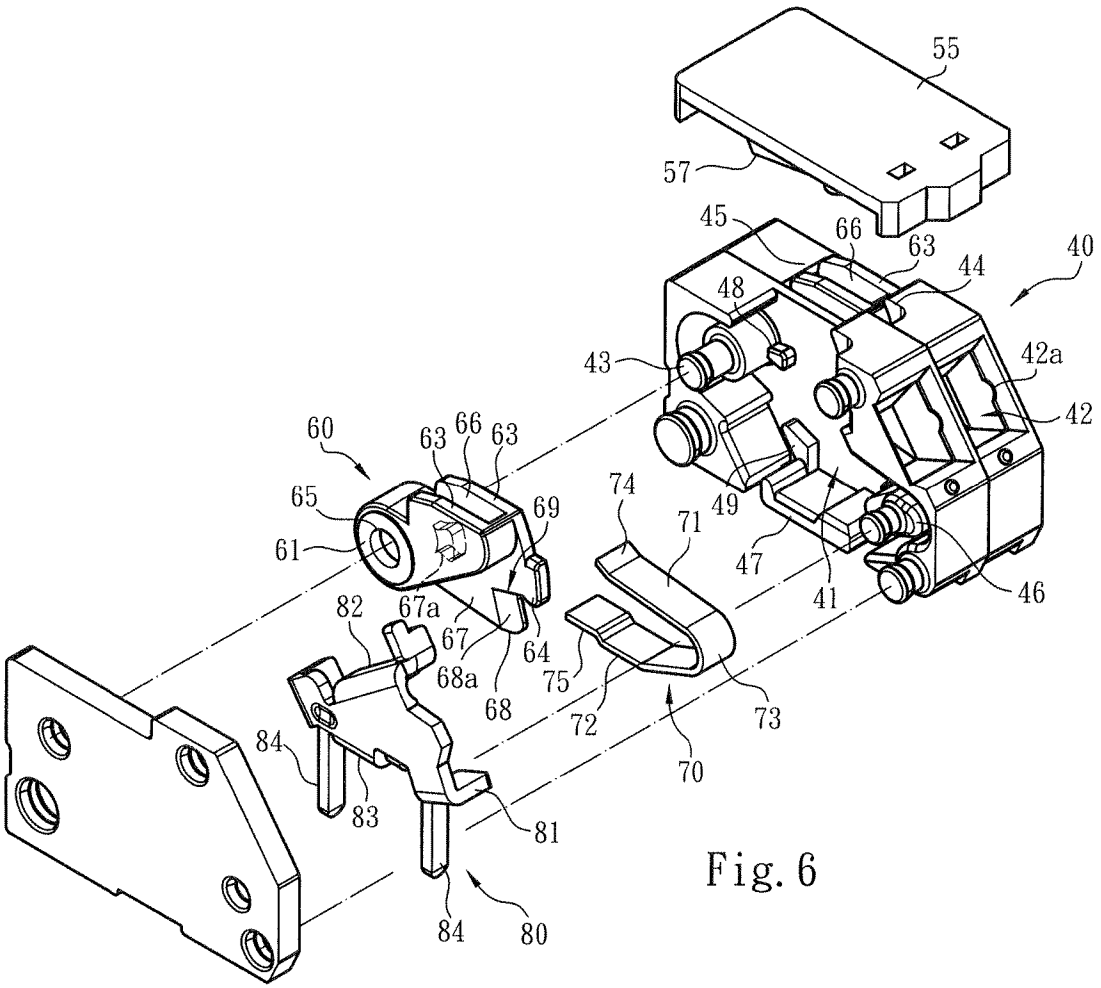
FIG. 6 is a perspective exploded view of the present invention, showing that the case, the pressing/moving unit, the metal leaf spring and the terminal pin component are assembled with each other.

Please refer to FIGS. 4, 5 and 6. The wire connection terminal device of the present invention includes a main body 40 made of insulation material and a pressing/moving unit 60 assembled with the main body 40. The main body 40 defines a chamber 41. A metal leaf spring 70 and a terminal pin component 80 are mounted in the chamber 41. The terminal pin component 80 is plugged on a circuit board (such as a PCB, not shown). The main body 40 includes a wire inlet 42 in communication with the chamber 41 and a recessed section 42*a* formed on the wire inlet 42. The recessed section 42*a* serves to help in guiding a conductive wire 50 to plug through the wire inlet 42 into the chamber 41. After plugged into the chamber 41, the conductive wire 50 is pressed by the metal leaf spring 70 and electrically connected with the terminal pin component 80.

The upper section, upper side, lower section, lower side or bottom section mentioned hereinafter are referred to with the direction of the drawings as the reference direction.

In this embodiment, the metal leaf spring 70 is responsive to the motion of the pressing/moving unit 60 to release the conductive wire 50. To speak more specifically, the pressing/moving unit 60 has a shafted section 61, a cam section 62 connected with the shafted section 61 and a force application section 63 formed on the cam section 62 and a press section 64 formed on the cam section 62.

As shown in the drawings, the shafted section 61 is formed with a shaft hole 65 pivotally connected on a shaft post 43 of the main body 40 (or the chamber 41). Accordingly, the cam section 62 can freely rotate or swing within the chamber 41 of the main body 40. The force application section 63 protrudes from an upper section of the cam section 62 to form two stepped structures. In addition, the force application section 63 and the cam section 62 together define a cavity 66. A base board 67 is formed on one side of the cam section 62 (or one of the stepped structures). One end of the base board 67 protrudes from the base board 67 to form the press section 64.

In this embodiment, as shown in the drawings, the upper section of the main body 40 is formed with a socket 44 and an insertion section 45 for detachably assembling with a cover 55. Corresponding to the socket 44 and the insertion section 45, the cover 55 is formed with an insertion block 56, an insertion portion 57 and a shoulder section 58 formed at a rear end of the insertion portion 57. Accordingly, when the insertion block 56 and the shoulder section 58 are respectively mounted into the socket 44 and the insertion section 45 of the main body 40, the insertion portion 57 of the cover 55 is received in the cavity 66 of the pressing/moving unit 60.

In a preferred embodiment, the main body 40 is formed with a stopper section 48 in adjacency to the shaft post 43. The stopper section 48 is a block body structure, which can cooperate with the base board 67 to hinder the pressing/moving unit 60 from being over-rotated. For example, the base board 67 can be formed with a protrusion section or a slot rail structure 67*a* assembled with the stopper section 48. When operating the pressing/moving unit 60 to swing, the slot rail structure 67*a* can cooperate with the stopper section 48 to restrict the rotation or swing of the pressing/moving unit 60 within a certain range.

The mechanism for restricting the rotation or swing of the pressing/moving unit 60 within a certain range can also include a stop section 49 formed on the main body 40 in the form of a block body structure. Therefore, when the base board 67 of the pressing/moving unit 60 is rotated or swung to a position where the stop section 49 is positioned, the stop section 49 will stop the base board 67 to prevent the pressing/moving unit 60 from being over-rotated or over-swung.

As shown in the drawings, the lower end section of the base board 67 is formed with a restriction section 68. The restriction section 68 has an extension face 68*a* in the form of a slope structure for guiding the conductive wire 50 to enter the terminal pin component 80. That is, when the conductive wire 50 passes through the extension face 68*a*, the slope structure of the extension face 68*a* will guide the conductive wire 50 into the terminal pin component 80. A notch 69 is formed between the restriction section 68 and the press section 64. The restriction section 68 also serves to help in restricting the rotation or swing of the pressing/moving unit 60 within a certain range. This will be further described hereinafter.

Please further refer to FIGS. 4, 5 and 6. The metal leaf spring 70 is a substantially U-shaped structure. The metal leaf spring 70 has a first section 71, a second section 72 and a bight section 73 connected between the first and second sections 71, 72. The first section 71 includes ahead end 74 and the second section 72 includes a tail end 75. The metal leaf spring 70 is mounted on a stake 46 of the main body 40, whereby the first section 71 and/or the head end 74 can move or swing within the chamber 41. As shown in the drawings, the pressing/moving unit 60 and the metal leaf spring 70 are respectively disposed on two sides of the chamber 41 of the main body 40.

Figure 7:
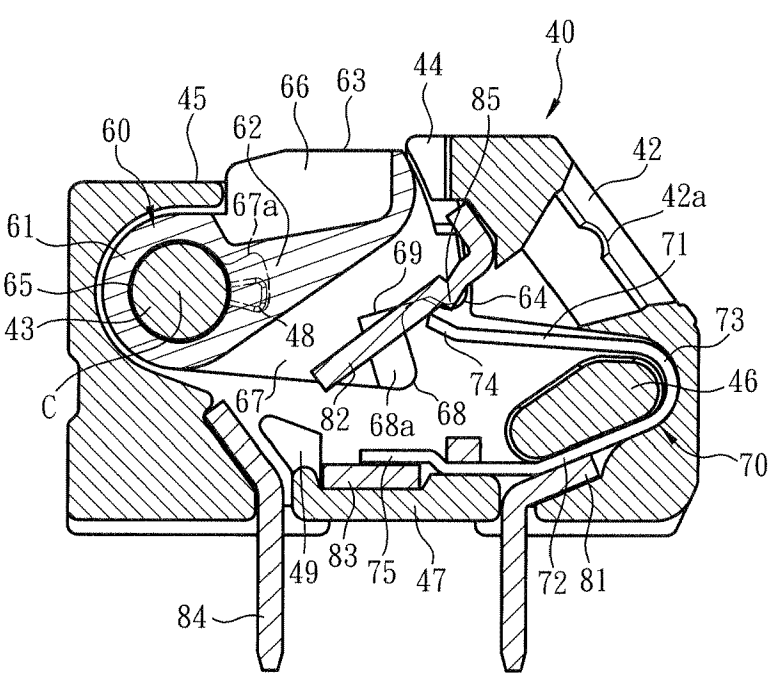
FIG. 7 is a structural plane view of the present invention, showing that the case, the pressing/moving unit, the metal leaf spring and the terminal pin component are cooperatively assembled with each other.

Please now refer to FIGS. 5, 6 and 7. The terminal pin component 80 is mounted in the chamber 41 of the main body 40. The terminal pin component 80 is a board body structure with a geometrical configuration. The terminal pin component 80 includes a first side 81, which is bent and formed on lower side of the board body structure, a second side 82 positioned above the first side 81, a subsidiary side 83 connected with the first side 81 and terminal pins 84 bent and protruding from the first side 81. The second side 82 has the form of a slope inclined from the first side 81. The inclination angle of the second side 82 is equal to the angle by which the conductive wire 50 is plugged into the main body 40 or the wire inlet 42, whereby the second side 82 can more snugly contact the conductive wire 50. In addition, the second side 82 has a tip 85 for helping the head end 74 of the metal leaf spring 70 to together bite the conductive wire 50 and truly secure the conductive wire 50.

As shown in the drawings, the first side 81 of the terminal pin component 80 is positioned on the bottom section 47 of the main body 40 with the terminal pins 84 extending out of the main body 40. In addition, the second section 72 and the tail end 75 of the metal leaf spring 70 respectively contact the first side 81 and the subsidiary side 83 of the terminal pin component 80. The head end 74 of the metal leaf spring 70 contacts the second side 82 of the terminal pin component 80.

Figure 8:
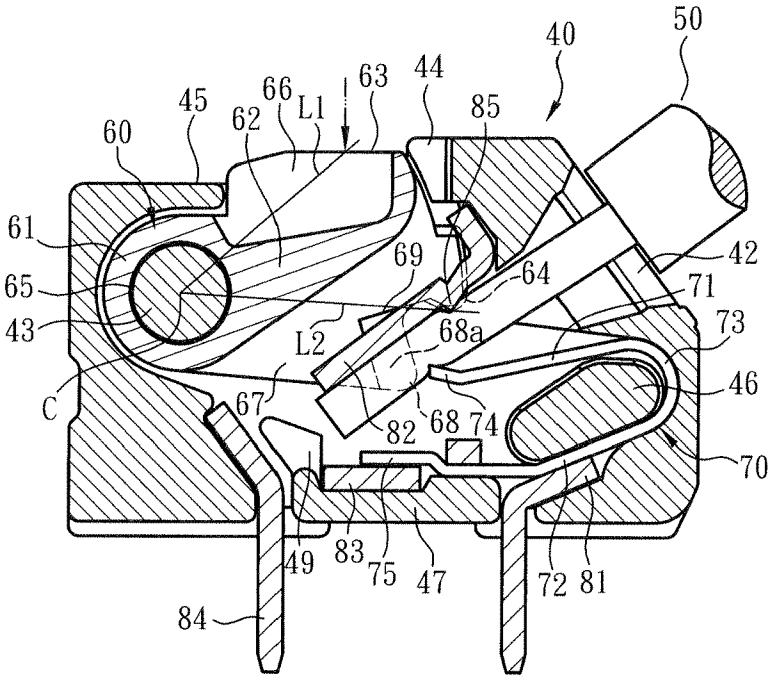
FIG. 8 is a structural plane view of the present invention, showing the operation of the present invention, in which the conductive wire is plugged into the case and the pressing/moving unit, the metal leaf spring and the terminal pin component are cooperatively assembled with each other.

Please now refer to FIG. 8. The above structurally cooperative form permits an operator to directly plug the conductive wire 50 through the wire inlet 42 into the chamber 41. Due to the elasticity of the metal leaf spring 70 and/or the head end 74, the conductive wire 50 can move along the second side 82 of the terminal pin component 80 to be pressed or bitten by the head end 74 of the metal leaf spring 70 and electrically connected with the terminal pin component 80 and the metal leaf spring 70.

Figure 9:
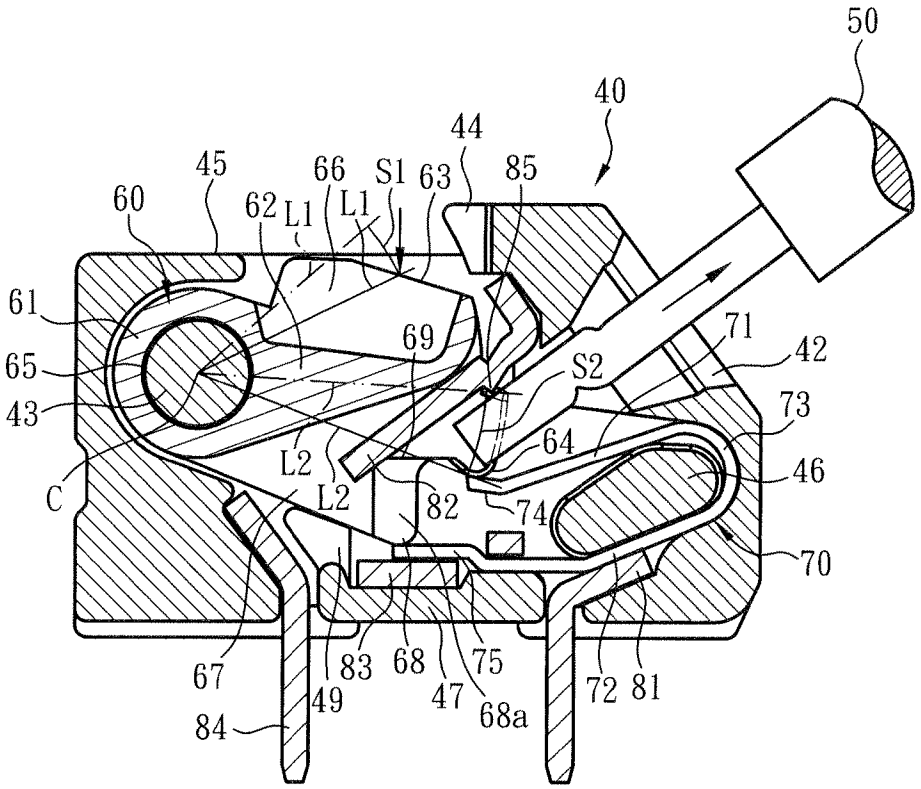
FIG. 9 is another structural plane view of the present invention, showing the operation of the present invention, in which the press section pushes/presses the metal leaf spring to release the conductive wire from the pressing of the metal leaf spring and the conductive wire is allowed to be extracted out of the case.

Please refer to FIG. 9. When the operator presses down the force application section 63 of the pressing/moving unit 60 (in the direction of the arrow), the press section 64 is driven to press down the head end 74 of the metal leaf spring 70 so as to release the conductive wire 50 from the pressing or biting of the head end 74. At this time, the operator can extract the conductive wire 50 out of the main body 40.

As shown in the drawings, the restriction section 68 of the pressing/moving unit 60 contacts the tail end 75 of the metal leaf spring 70 or the base board 67 is stopped by the stop section 49 of the main body 40. That is, the rotation range or swing range of the pressing/moving unit 60 is set to the position where the restriction section 68 reaches the tail end 75 of the metal leaf spring 70 or the first side 81 (or the subsidiary side 83) of the terminal pin component 80, or the rotation range or swing range of the pressing/moving unit 60 is set to the position where the base board 67 reaches the stop section 49. In this case, the pressing/moving unit 60 will not be over-rotated or swung.

It should be noted that in case the position where the shaft hole 65 of the pressing/moving unit 60 is pivotally connected with the shaft post 43 as a fulcrum is defined as a rotational center or swinging center C, the length L1 between the force application section 63 (or the force application point) and the swinging center C (or the shaft hole 65 and the shaft post 43) is smaller than the length L2 between the press section 64 and the swinging center C (or the shaft hole 65 and the shaft post 43). Accordingly, the (depressing) displacement S1 of the force application section 63 is smaller than the (depressing) displacement S2 of the press section 64. That is, in comparison with the conventional terminal device, the motional travel of the pressing/moving unit 60 or the force application section 63 is as minimized as possible. The operator only needs to operate the force application section 63 to move by a smaller amount or travel so as to release the conductive wire 50 from the pressing of the head end 74 of the metal leaf spring 70 and electrically disconnect the conductive wire 50 from the metal leaf spring 70.

It should be noted that the (depressing) operational direction of the force application section 63 or the press section 64 is as identical to the (longitudinal) motional direction of the metal leaf spring 70 as possible. This is beneficial to directly press the head end 74 of the metal leaf spring 70. In this case, the shortcoming of the conventional structure that it is laborious to use a push member to laterally push/press the metal leaf spring.

To speak representatively, the wire connection terminal device of the present invention can be stably operated to truly press the conductive wire. In comparison with the conventional terminal device, the wire connection terminal device of the present invention has the following advantages:

1. The terminal device or the relevant connection components thereof have been redesigned in use, structural design and connection relationship. For example, the main body 40 is formed with the socket 44 and the insertion section 45 assembled with the insertion block 56, the insertion portion 57 and the shoulder section 58 of the cover 55. The pressing/moving unit 60 has a shafted section 61, whereby the cam section 62 can freely rotate or swing within the chamber 41 of the main body 40. The force application section 63 and the cam section 62 together define the cavity 66 for receiving therein the insertion portion 57. The base board 67 is formed on one side of the cam section 62 and one end of the base board 67 protrudes from the base board 67 to form the press section 64 and the restriction section 68. The terminal pin component 80 includes the first side 81, the subsidiary side 83 and the second side 82 in the form of a slope in cooperation with the metal leaf spring 70. The use form and application of the terminal device of the present invention are obviously changed and different from the conventional terminal device.
2. The length between the force application section 63 of the pressing/moving unit 60 and the shafted section 61 (or the swinging center C) is smaller than the length between the press section 64 and the shafted section 61 (or the swinging center C). Accordingly, the operational travel of the force application section 63 is obviously smaller than the operational travel of the conventional structure. The pressing/moving unit 60 and/or the force application section 63 can be as disposed in the main body 40 as possible without protruding from the main body 40 so as to minimize the possibility of mis-touch of an operator. Moreover, in the conventional terminal device, it is necessary to enlarge the volume of the case to provide sufficient operational travel or reserve operational space to affect the arrangement space of the working site and the environmental equipment. The terminal device of the present invention apparently improves the shortcomings of the conventional terminal device.

In conclusion, the wire connection terminal device of the present invention is effective and different from the conventional terminal device in space form. The wire connection terminal device of the present invention is inventive, greatly advanced and advantageous over the conventional terminal device.

The above embodiments are only used to illustrate the present invention, not intended to limit the scope thereof. Many modifications of the above embodiments can be made without departing from the spirit of the present invention.

What is claimed is:

1. A wire connection terminal device comprising a main body and a pressing/moving unit assembled with the main body, the main body defining a chamber, a metal leaf spring and a terminal pin component being mounted in the chamber, the main body being formed with a wire inlet in communication with the chamber, the pressing/moving unit having a shafted section, a cam section connected with the shafted section and a force application section formed on the cam section and a press section formed on the cam section, the shafted section being pivotally connected on a shaft post of the main body, the cam section being disposed to freely swing within the chamber to alternatively engage and disengage from the metal leaf spring, a length between the force application section and the shafted section being smaller than a length between the press section and the shafted section.

2. The wire connection terminal device as claimed in claim 1, wherein the terminal pin component is a board body structure with a geometrical configuration, the terminal pin component including a first side formed on a lower side of the board body structure, a second side positioned above the first side, a subsidiary side connected with the first side and terminal pins bent and protruding from the first side, the second side having the form of a slope inclined from the first side, the second side having a tip, an inclination angle of the second side being equal to an angle by which a conductive wire is plugged into the wire inlet of the main body, the first side of the terminal pin component being positioned on a bottom section of the main body with the terminal pins extending out of the main body, the metal leaf spring having a first section, a second section and a bight section connected between the first and second sections, the first section including a head end, the second section including a tail end, the metal leaf spring being mounted on a stake of the main body, whereby the first section and the head end can swing within the chamber, the second section and the tail end of the metal leaf spring respectively contacting the first side and the subsidiary side of the terminal pin component, the head end of the metal leaf spring contacting the second side of the terminal pin component.

3. The wire connection terminal device as claimed in claim 2, wherein an upper section of the main body is formed with a socket and an insertion section for detachably assembling with a cover corresponding to the socket and the insertion section, the cover being formed with an insertion block, an insertion portion and a shoulder section formed at a rear end of the insertion portion.

4. The wire connection terminal device as claimed in claim 3, wherein the shafted section of the pressing/moving unit is defined with a swinging center, a length between the force application section and the swinging center being smaller than a length between the press section and the swinging center, whereby the displacement of the force application section is smaller than the displacement of the press section.

5. The wire connection terminal device as claimed in claim 3, wherein an operational direction of the force application section or the press section is substantially identical to a motional direction of the metal leaf spring.

6. The wire connection terminal device as claimed in claim 2, wherein the shafted section of the pressing/moving unit is defined with a swinging center, a length between the force application section and the swinging center being smaller than a length between the press section and the swinging center, whereby the displacement of the force application section is smaller than the displacement of the press section.

7. The wire connection terminal device as claimed in claim 6, wherein an operational direction of the force application section or the press section is substantially identical to a motional direction of the metal leaf spring.

8. The wire connection terminal device as claimed in claim 2, wherein an operational direction of the force application section or the press section is substantially identical to a motional direction of the metal leaf spring.

9. The wire connection terminal device as claimed in claim 1, wherein an upper section of the main body is formed with a socket and an insertion section for detachably assembling with a cover corresponding to the socket and the insertion section, the cover being formed with an insertion block, an insertion portion and a shoulder section formed at a rear end of the insertion portion.

10. The wire connection terminal device as claimed in claim 9, wherein the shafted section of the pressing/moving unit is defined with a swinging center, a length between the force application section and the swinging center being smaller than a length between the press section and the swinging center, whereby the displacement of the force application section is smaller than the displacement of the press section.

11. The wire connection terminal device as claimed in claim 9, wherein an operational direction of the force application section or the press section is substantially identical to a motional direction of the metal leaf spring.

12. The wire connection terminal device as claimed in claim 1, wherein the shafted section of the pressing/moving unit is defined with a swinging center, a length between the force application section and the swinging center being smaller than a length between the press section and the swinging center, whereby the displacement of the force application section is smaller than the displacement of the press section.

13. The wire connection terminal device as claimed in claim 12, wherein an operational direction of the force application section or the press section is substantially identical to a motional direction of the metal leaf spring.

14. A wire connection terminal device comprising a main body and a pressing/moving unit assembled with the main body, the main body defining a chamber, a metal leaf spring and a terminal pin component being mounted in the chamber, the main body being formed with a wire inlet in communication with the chamber, the pressing/moving unit having a shafted section, a cam section extending from a side of the shafted section, a force application section and a press section being formed on the cam section, the shafted section being pivotally connected on a shaft post of the main body, whereby the cam section can freely swing within the chamber between first and second positions, the force application section protruding from the main body when the cam section is at the first position, a length between the force application section and the shafted section being smaller than a length between the press section and the shafted section;

wherein the shafted section is formed with a shaft hole pivotally connected on the shaft post of the main body, a base board being formed on one side of the cam section, one end of the base board protruding to form the press section, a recessed section being formed on one side of the wire inlet.

15. The wire connection terminal device as claimed in claim 14, wherein the terminal pin component is a board body structure with a geometrical configuration, the terminal pin component including a first side formed on a lower side of the board body structure, a second side positioned above the first side, a subsidiary side connected with the first side and terminal pins bent and protruding from the first side, the second side having the form of a slope inclined from the first side, the second side having a tip, an inclination angle of the second side being equal to an angle by which a conductive wire is plugged into the wire inlet of the main body, the first side of the terminal pin component being positioned on a bottom section of the main body with the terminal pins extending out of the main body, the metal leaf spring having a first section, a second section and a bight section connected between the first and second sections, the first section including a head end, the second section including a tail end, the metal leaf spring being mounted on a stake of the main body, whereby the first section and the head end can swing within the chamber, the second section and the tail end of the metal leaf spring respectively contacting the first side and the subsidiary side of the terminal pin component, the head end of the metal leaf spring contacting the second side of the terminal pin component.

16. The wire connection terminal device as claimed in claim 15, wherein an upper section of the main body is formed with a socket and an insertion section for detachably assembling with a cover corresponding to the socket and the insertion section, the cover being formed with an insertion block, an insertion portion and a shoulder section formed at a rear end of the insertion portion.

17. The wire connection terminal device as claimed in claim 15, wherein the shafted section of the pressing/moving unit is defined with a swinging center, a length between the force application section and the swinging center being smaller than a length between the press section and the swinging center, whereby the displacement of the force application section is smaller than the displacement of the press section.

18. The wire connection terminal device as claimed in claim 17, wherein an operational direction of the force application section or the press section is substantially identical to a motional direction of the metal leaf spring.

19. The wire connection terminal device as claimed in claim 15, wherein an operational direction of the force application section or the press section is substantially identical to a motional direction of the metal leaf spring.

20. The wire connection terminal device as claimed in claim 14, wherein an upper section of the main body is formed with a socket and an insertion section for detachably assembling with a cover corresponding to the socket and the insertion section, the cover being formed with an insertion block, an insertion portion and a shoulder section formed at a rear end of the insertion portion.

21. The wire connection terminal device as claimed in claim 14, wherein the shafted section of the pressing/moving unit is defined with a swinging center, a length between the force application section and the swinging center being smaller than a length between the press section and the swinging center, whereby the displacement of the force application section is smaller than the displacement of the press section.

22. The wire connection terminal device as claimed in claim 14, wherein an operational direction of the press section is substantially identical to a motional direction of the metal leaf spring.

23. A wire connection terminal device comprising a main body and a pressing/moving unit assembled with the main body, the main body defining a chamber, a metal leaf spring and a terminal pin component being mounted in the chamber, the main body being formed with a wire inlet in communication with the chamber, the pressing/moving unit having a shafted section, a cam section connected with the shafted section and a force application section formed on the cam section and a press section formed on the cam section, the shafted section being pivotally connected on a shaft post of the main body, whereby the cam section can freely swing within the chamber, a length between the force application section and the shafted section being smaller than a length between the press section and the shafted section;

wherein the force application section protrudes from an upper section of the cam section to form two stepped structures, the force application section and the cam section together defining a cavity, a lower end section of the base board being formed with a restriction section, a notch being formed between the restriction section and the press section, the restriction section having an extension face in the form of a slope structure.

24. The wire connection terminal device as claimed in claim 23, wherein the pressing/moving unit and the metal leaf spring are respectively disposed on two sides of the chamber of the main body, the metal leaf spring being a U-shaped structure, the main body being formed with a stopper section in the form of a block body structure and a stop section, the stopper section being in adjacency to the shaft post, the base board being formed with a protrusion section or a slot rail structure in cooperation with the stopper section to restrict the move of the pressing/moving unit within a certain range.

25. The wire connection terminal device as claimed in claim 24, wherein the terminal pin component is a board body structure with a geometrical configuration, the terminal pin component including a first side formed on a lower side of the board body structure, a second side positioned above the first side, a subsidiary side connected with the first side and terminal pins bent and protruding from the first side, the second side having the form of a slope inclined from the first side, the second side having a tip, an inclination angle of the second side being equal to an angle by which a conductive wire is plugged into the wire inlet of the main body, the first side of the terminal pin component being positioned on a bottom section of the main body with the terminal pins extending out of the main body, the metal leaf spring having a first section, a second section and a bight section connected between the first and second sections, the first section including a head end, the second section including a tail end, the metal leaf spring being mounted on a stake of the main body, whereby the first section and the head end can swing within the chamber, the second section and the tail end of the metal leaf spring respectively contacting the first side and the subsidiary side of the terminal pin component, the head end of the metal leaf spring contacting the second side of the terminal pin component.

26. The wire connection terminal device as claimed in claim 25, wherein an upper section of the main body is formed with a socket and an insertion section for detachably assembling with a cover corresponding to the socket and the insertion section, the cover being formed with an insertion block, an insertion portion and a shoulder section formed at a rear end of the insertion portion.

27. The wire connection terminal device as claimed in claim 25, wherein the shafted section of the pressing/moving unit is defined with a swinging center, a length between the force application section and the swinging center being smaller than a length between the press section and the swinging center, whereby the displacement of the force application section is smaller than the displacement of the press section.

28. The wire connection terminal device as claimed in claim 25, wherein an operational direction of the force application section or the press section is substantially identical to a motional direction of the metal leaf spring.

29. The wire connection terminal device as claimed in claim 24, wherein an upper section of the main body is formed with a socket and an insertion section for detachably assembling with a cover corresponding to the socket and the insertion section, the cover being formed with an insertion block, an insertion portion and a shoulder section formed at a rear end of the insertion portion, the cover being assembled with the main body with the insertion portion received in the cavity of the pressing/moving unit.

30. The wire connection terminal device as claimed in claim 29, wherein the shafted section of the pressing/moving unit is defined with a swinging center, a length between the force application section and the swinging center being smaller than a length between the press section and the swinging center, whereby the displacement of the force application section is smaller than the displacement of the press section.

31. The wire connection terminal device as claimed in claim 29, wherein an operational direction of the force application section or the press section is substantially identical to a motional direction of the metal leaf spring.

32. The wire connection terminal device as claimed in claim 24, wherein the shafted section of the pressing/moving unit is defined with a swinging center, a length between the force application section and the swinging center being smaller than a length between the press section and the swinging center, whereby the displacement of the force application section is smaller than the displacement of the press section.

33. The wire connection terminal device as claimed in claim 32, wherein an operational direction of the force application section or the press section is substantially identical to a motional direction of the metal leaf spring.

34. The wire connection terminal device as claimed in claim 24, wherein an operational direction of the force application section or the press section is substantially identical to a motional direction of the metal leaf spring.

35. The wire connection terminal device as claimed in claim 23, wherein the terminal pin component is a board body structure with a geometrical configuration, the terminal pin component including a first side formed on a lower side of the board body structure, a second side positioned above the first side, a subsidiary side connected with the first side and terminal pins bent and protruding from the first side, the second side having the form of a slope inclined from the first side, the second side having a tip, an inclination angle of the second side being equal to an angle by which a conductive wire is plugged into the wire inlet of the main body, the first side of the terminal pin component being positioned on a bottom section of the main body with the terminal pins extending out of the main body, the metal leaf spring having a first section, a second section and a bight section connected between the first and second sections, the first section including a head end, the second section including a tail end, the metal leaf spring being mounted on a stake of the main body, whereby the first section and the head end can swing within the chamber, the second section and the tail end of the metal leaf spring respectively contacting the first side and the subsidiary side of the terminal pin component, the head end of the metal leaf spring contacting the second side of the terminal pin component.

36. The wire connection terminal device as claimed in claim 35, wherein an upper section of the main body is formed with a socket and an insertion section for detachably assembling with a cover corresponding to the socket and the insertion section, the cover being formed with an insertion block, an insertion portion and a shoulder section formed at a rear end of the insertion portion.

37. The wire connection terminal device as claimed in claim 35, wherein the shafted section of the pressing/moving unit is defined with a swinging center, a length between the force application section and the swinging center being smaller than a length between the press section and the swinging center, whereby the displacement of the force application section is smaller than the displacement of the press section.

38. The wire connection terminal device as claimed in claim 35, wherein an operational direction of the force application section or the press section is substantially identical to a motional direction of the metal leaf spring.

39. The wire connection terminal device as claimed in claim 23, wherein an upper section of the main body is formed with a socket and an insertion section for detachably assembling with a cover corresponding to the socket and the insertion section, the cover being formed with an insertion block, an insertion portion and a shoulder section formed at a rear end of the insertion portion, the cover being assembled with the main body with the insertion portion received in the cavity of the pressing/moving unit.

40. The wire connection terminal device as claimed in claim 39, wherein the shafted section of the pressing/moving unit is defined with a swinging center, a length between the force application section and the swinging center being smaller than a length between the press section and the swinging center, whereby the displacement of the force application section is smaller than the displacement of the press section.

41. The wire connection terminal device as claimed in claim 39, wherein an operational direction of the force application section or the press section is substantially identical to a motional direction of the metal leaf spring.

42. The wire connection terminal device as claimed in claim 23, wherein the shafted section of the pressing/moving unit is defined with a swinging center, a length between the force application section and the swinging center being smaller than a length between the press section and the swinging center, whereby the displacement of the force application section is smaller than the displacement of the press section.

43. The wire connection terminal device as claimed in claim 42, wherein an operational direction of the force application section or the press section is substantially identical to a motional direction of the metal leaf spring.

44. The wire connection terminal device as claimed in claim 23, wherein an operational direction of the force application section or the press section is substantially identical to a motional direction of the metal leaf spring.

* * * * *